US009400515B2

(12) United States Patent
Tomioka et al.

(10) Patent No.: US 9,400,515 B2
(45) Date of Patent: Jul. 26, 2016

(54) VOLTAGE REGULATOR AND ELECTRONIC APPARATUS

(71) Applicant: Seiko Instruments Inc., Chiba-shi, Chiba (JP)

(72) Inventors: Tsutomu Tomioka, Chiba (JP); Masakazu Sugiura, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 14/575,287

(22) Filed: Dec. 18, 2014

(65) Prior Publication Data

US 2015/0188423 A1 Jul. 2, 2015

(30) Foreign Application Priority Data

Dec. 27, 2013 (JP) ..... 2013-273240

(51) Int. Cl.

| | |
|---|---|
| ***G05F 1/571*** | (2006.01) |
| ***G05F 1/575*** | (2006.01) |
| *G05F 1/565* | (2006.01) |
| *G05F 1/56* | (2006.01) |
| *G05F 1/46* | (2006.01) |

(52) U.S. Cl.

CPC ..... *G05F 1/571* (2013.01); *G05F 1/575* (2013.01); *G05F 1/468* (2013.01); *G05F 1/562* (2013.01); *G05F 1/565* (2013.01)

(58) Field of Classification Search

CPC ..... H02M 3/156; H02M 3/137; G05F 1/468; G05F 1/68; G05F 1/562; G05F 1/565; G05F 1/575

USPC ..... 323/282

See application file for complete search history.

(56) References Cited

U.S. PATENT DOCUMENTS

| | | | | |
|---|---|---|---|---|
| 2009/0273331 | A1 | 11/2009 | Inoue | |
| 2010/0320993 | A1* | 12/2010 | Yoshii | H03F 3/347 323/312 |
| 2012/0013317 | A1* | 1/2012 | Morino | G05F 1/565 323/280 |
| 2014/0070778 | A1* | 3/2014 | Nihei | G05F 1/575 323/271 |

FOREIGN PATENT DOCUMENTS

| | | |
|---|---|---|
| JP | 2007-157071 A | 6/2007 |

* cited by examiner

*Primary Examiner* — Fred E Finch, III
*Assistant Examiner* — Rafael O De Leon Domenech
(74) *Attorney, Agent, or Firm* — Brinks Gilson & Lione

(57) ABSTRACT

A voltage regulator is provided which can suppress an occurrence of overshooting in an output voltage at the time of starting a power source with a source voltage or the like. The voltage regulator includes an error amplifier circuit, an overshooting control circuit that is connected to the gate of an output transistor, and an ON/OFF circuit that controls ON and OFF states of at least the error amplifier circuit. Here, the ON/OFF circuit controls the overshooting control circuit so as to turn on the output transistor when a predetermined time passes after at least the error amplifier circuit is turned on at the time of starting the voltage regulator.

5 Claims, 3 Drawing Sheets

VOLTAGE REGULATOR AND ELECTRONIC APPARATUS

RELATED APPLICATIONS

This application claims priority under 35 U.S.C. §119 to Japanese Patent Application No. 2013-273240 filed on Dec. 27, 2013, the entire content of which is hereby incorporated by reference.

BACKGROUND OF THE INVENTION

1. Field of the Invention

The present invention relates to a voltage regulator that is disposed as a power source of a portable apparatus or an electronic apparatus so as to output a constant voltage, and more particularly, to a voltage regulator that can suppress an occurrence of overshooting in an output voltage at the time of starting a power source with a source voltage.

2. Background Art

A voltage regulator according to the related art will be described below. FIG. 3 is a circuit diagram illustrating a voltage regulator according to the related art.

The voltage regulator according to the related art includes an error amplifier circuit 104, a reference voltage circuit 103, PMOS transistors 901 and 902, an output transistor 110, resistors 105 and 106, and 903, a capacitor 904, a ground terminal 100, an output terminal 102, and a power source terminal 101.

The resistors 105 and 106 are disposed in series between the output terminal 102 and the ground terminal 100 and divide an output voltage Vout of the output terminal 102. When the voltage of the connecting point of the resistors 105 and 106 is defined as Vfb, the error amplifier circuit 104 controls the gate voltage of the output transistor 110 such that the voltage Vfb gets close to the voltage Vref of the reference voltage circuit 103, and outputs the output voltage Vout to the output terminal 102. When the source voltage VDD of the power source terminal 101 increases, a current Ix1 flows from the power source terminal 101 to the fluctuation detecting capacitor 904. The current Ix1 is amplified by a current feedback circuit including the PMOS transistors 901 and 902 and the resistor 903 and a current Ix2 is generated. The current Ix2 is supplied to the gate of the output transistor 110 and charges the gate capacitor of the output transistor 110. In this way, the gate-source voltage VGS of the output transistor 110 is regulated to an appropriate value even when the source voltage VDD fluctuates and it is thus possible to suppress the overshooting and to stabilize the output voltage (for example, see Patent Document 1).

[Patent Document 1] Japanese Patent Application Laid-Open No. 2007-157071

SUMMARY OF THE INVENTION

However, the voltage regulator according to the related art has a problem in that the current Ix2 is not supplied to the gate of the output transistor at a proper time and thus great overshooting occurs in the output voltage when the source voltage rapidly increases such as when starting the power source.

The invention is made in consideration of the above-mentioned problem and an object thereof is to provide a voltage regulator that can suppress an occurrence of overshooting in an output voltage even at the time of starting a power source.

In order to achieve the above-mentioned object, a voltage regulator according to the invention has the following configuration.

The voltage regulator includes: an error amplifier circuit; an overshooting control circuit that is connected to the gate of the output transistor; and an ON/OFF circuit that controls ON and OFF states of at least the error amplifier circuit. Here, the ON/OFF circuit controls the overshooting control circuit so as to turn on the output transistor when a predetermined time passes after at least the error amplifier circuit is turned on at the time of starting the voltage regulator.

The voltage regulator according to the invention can suppress the occurrence of overshooting in the output voltage at the starting time at which the circuitry is turned on from a state in which the circuitry is turned off by the ON/OFF circuit by supplying a source voltage.

It is also possible to prevent erroneous operations or malfunction of a portable apparatus or an electronic apparatus that operates using the voltage regulator as a power source.

DETAILED DESCRIPTION OF THE PREFERRED EMBODIMENTS

Figure 1:
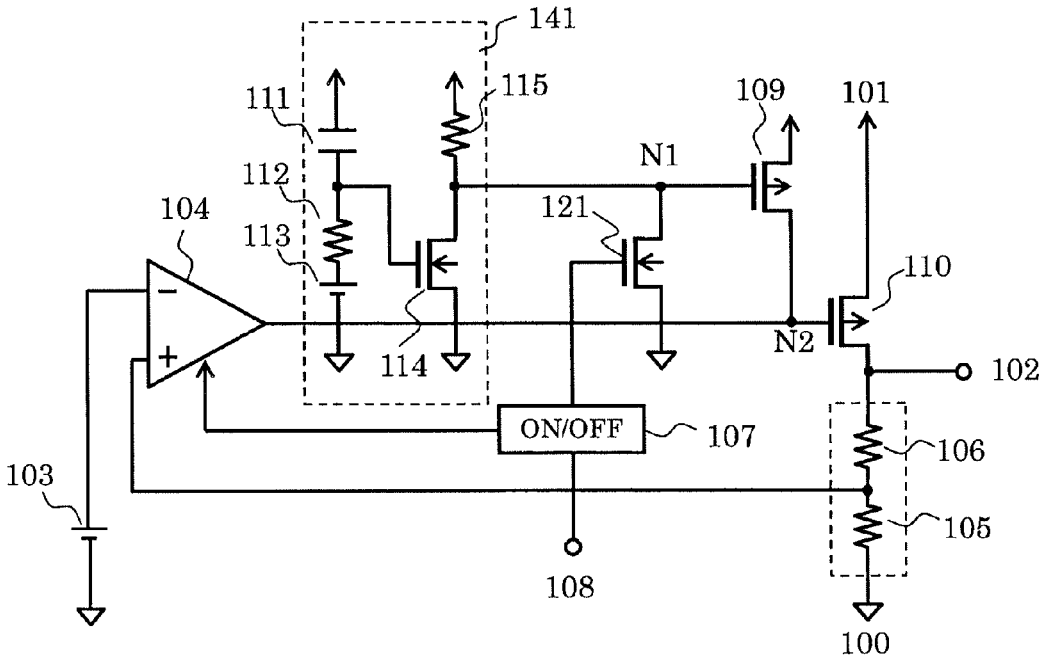
FIG. 1 is a circuit diagram illustrating an example of a voltage regulator according to an embodiment of the invention.

FIG. 1 is a circuit diagram illustrating an example of a voltage regulator according to an embodiment of the invention.

The voltage regulator according to this embodiment includes an error amplifier circuit 104, a reference voltage circuit 103, resistors 105 and 106 constituting a voltage divider circuit, PMOS transistors 109 and 110, NMOS transistors 114 and 121, resistors 112 and 115, a capacitor 111, a constant voltage circuit 113, an ON/OFF circuit 107, a ground terminal 100, a power source terminal 101, an output terminal 102, and an ON/OFF control terminal 108.

The capacitor 111, the resistors 112 and 115, the constant voltage circuit 113, and the NMOS transistor 114 constitute a source voltage fluctuation detector circuit 141. The PMOS transistor 109 constitutes an overshooting control circuit. The ON/OFF circuit 107 controls ON and OFF states of circuits of the voltage regulator using ON/OFF signals input to the ON/OFF control terminal 108 from the outside. Here, the ON/OFF circuit 107 includes a first control terminal for outputting a first control signal for controlling the ON and OFF states of the circuit including the error amplifier circuit 104 of the voltage regulator and a second control terminal for outputting a second control signal for controlling the ON and OFF states of the NMOS transistor 114. The second control terminal includes a delay circuit.

The connection of the voltage regulator according to this embodiment will be described below.

The inverting input terminal of the error amplifier circuit 104 is connected to the positive electrode of the reference voltage circuit 103 and the non-inverting input terminal thereof is connected to the output terminal of the voltage divider circuit. The resistor 105 and the resistor 106 of the voltage divider circuit are connected in series between the ground terminal 100 and the output terminal 102. In the PMOS transistor 110 as the output transistor, the gate (node N2) is connected to the output terminal of the error amplifier circuit 104, the source is connected to the power source terminal 101, and the drain is connected to the output terminal 102. In the PMOS transistor 109, the gate (node N1) is connected to the output terminal of the source voltage fluctuation detector circuit 141, the drain is connected to the gate of the PMOS transistor 110, and the source is connected to the power source terminal 101. In the ON/OFF circuit 107, the input terminal is connected to the ON/OFF control terminal 108 and a first output terminal is connected to the ON/OFF control terminal of the error amplifier circuit 104. In the NMOS transistor 121, the gate is connected to a second output terminal of the ON/OFF circuit 107, the drain is connected to the drain of the NMOS transistor 114, and the source is connected to the ground terminal 100.

One terminal of the capacitor 111 is connected to the power source terminal 101 and the other terminal thereof is connected to one terminal of the resistor 112. The positive electrode of the constant voltage circuit 113 is connected to the other terminal of the resistor 112 and the negative electrode is connected to the ground terminal 100. One terminal of the resistor 115 is connected to the power source terminal 101 and the other terminal thereof is connected to the drain of the NMOS transistor 114. The gate of the NMOS transistor 114 is connected to the connecting point of the capacitor 111 and the resistor 112 and the source thereof is connected to the ground terminal 100.

The operation of the voltage regulator according to this embodiment will be described below.

When the source voltage VDD is input to the power source terminal 101, the voltage regulator outputs the output voltage Vout from the output terminal 102. The voltage divider circuit divides the output voltage Vout and outputs a divided voltage Vfb. The error amplifier circuit 104 compares the divided voltage Vfb with the reference voltage Vref of the reference voltage circuit 103 and controls the gate voltage of the PMOS transistor 110 working as the output transistor so that the output voltage Vout is kept constant.

When the output voltage Vout is higher than a predetermined voltage, the divided voltage Vfb is higher than the reference voltage Vref. Accordingly, the output signal of the error amplifier circuit 104 (the gate voltage of the PMOS transistor 110) becomes higher, the PMOS transistor 110 is turned off, and thus the output voltage Vout becomes lower. When the output voltage Vout is lower than the predetermined voltage, the output voltage Vout becomes higher through the opposite operations to the above-mentioned operation. In this way, the voltage regulator works to keep the output voltage Vout constant.

When overshooting occurs in the source voltage VDD, the capacitor 111 detects the overshooting and turns on the NMOS transistor 114. A Lo signal is output from the source voltage fluctuation detector circuit 141 to turn on the PMOS transistor 109, and the gate voltage of the PMOS transistor 110 is changed to a High state to turn off the PMOS transistor 110, thereby suppressing the occurrence of the overshooting in the output voltage.

Here, the operation when an ON signal is input to the ON/OFF control terminal 108 and the voltage regulator is switched from the OFF state to the ON state will be considered. The gate of the PMOS transistor 109 is referred to as node N1 and the gate of the PMOS transistor 110 is referred to as node N2.

At this time, the source voltage VDD is supplied to the power source terminal 101. The error amplifier circuit 104 is turned off by a first output signal of the ON/OFF circuit 107. The NMOS transistor 121 is turned on by a second output signal of the ON/OFF circuit 107. Since the node N1 is in the Lo state, the PMOS transistor 109 is turned on and the node N2 is in the High state. Accordingly, since the PMOS transistor 110 is turned off, no voltage is output to the output terminal 102 even when the source voltage VDD is supplied to the power source terminal 101.

When an ON signal is input to the ON/OFF control terminal 108, the error amplifier circuit 104 is turned on by the first control signal of the ON/OFF circuit 107 and the other circuits start their operations at the same time. Here, since the second control terminal of the ON/OFF circuit 107 includes the delay circuit, the ON signal of the second control signal is output when a predetermined delay time passes after the ON signal of the first control signal is output. Accordingly, the ON/OFF circuit 107 outputs the ON signal of the second control signal when the error amplifier circuit 104 or the other circuits start their operations after the ON signal is input to the ON/OFF control terminal 108. That is, after the voltage regulator becomes a normally-operating state, the PMOS transistor 110 is turned on and outputs the output voltage VOUT to the output terminal 102.

The voltage regulator according to this embodiment can suppress the occurrence of overshooting in the output voltage VOUT at the starting time at which the circuitry is turned on from a state in which the circuitry is turned off by the ON/OFF circuit 107 by supplying the source voltage VDD thereto.

This embodiment has described the configuration in which a signal is input to the ON/OFF control terminal 108 form the outside, but a signal from an UVLO circuit may be input to the terminal. By employing this configuration, even when the source voltage VDD increases from a voltage equal to or lower than the operating voltage, it is possible to suppress the occurrence of overshooting in the output voltage VOUT through the same operation.

The ON/OFF circuit 107 may be configured such that the second control signal slowly increases. In this configuration, the advantageous effect becomes greater.

As described above, in the voltage regulator according to this embodiment, it is possible to suppress the occurrence of overshooting in the output voltage VOUT at the time of starting the power source with the source voltage VDD or at the starting time at which the circuitry is turned on from the state in which the circuitry turned off by the ON/OFF circuit 107 by supplying the source voltage VDD thereto.

Figure 2:
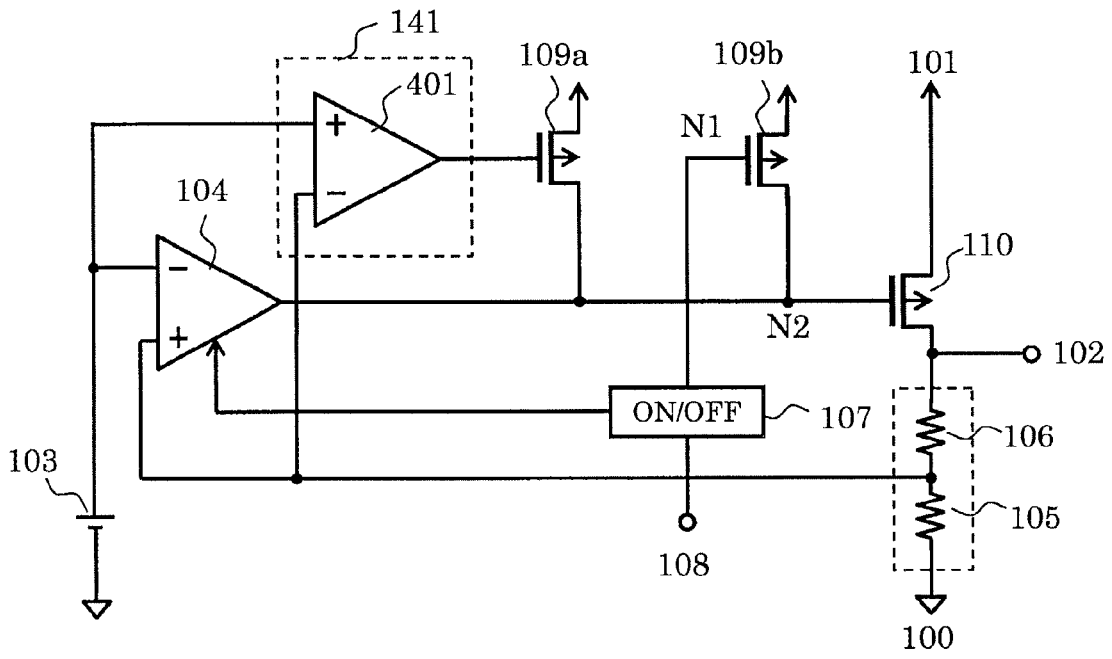
FIG. 2 is a circuit diagram illustrating another example of the voltage regulator according to the embodiment.
Figure 3:
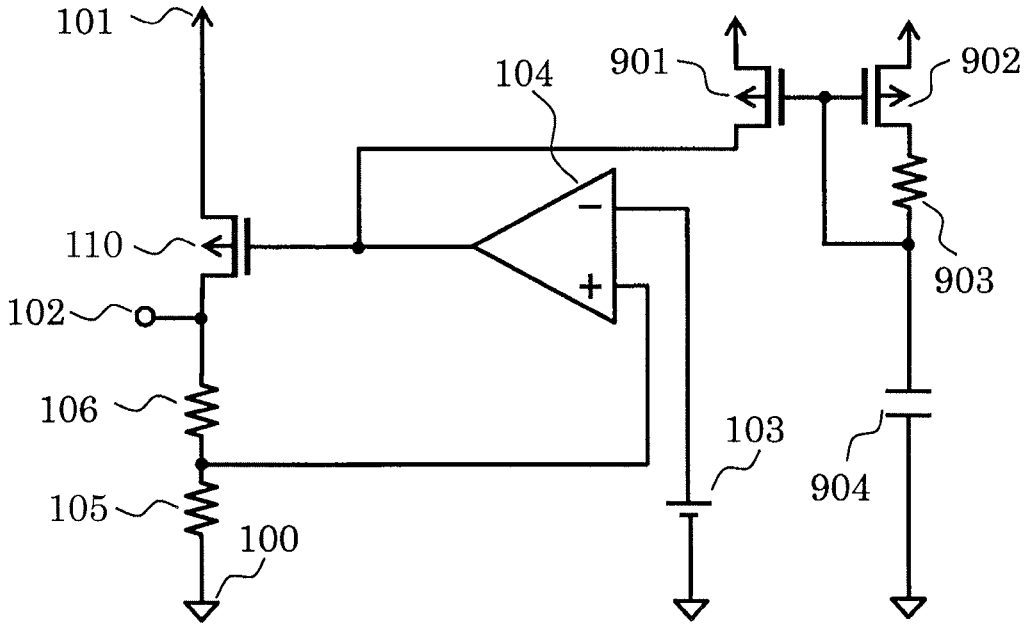
FIG. 3 PRIOR ART
FIG. 3 is a circuit diagram illustrating a voltage regulator according to the related art.

FIG. 2 is a circuit diagram illustrating another example of the voltage regulator according to this embodiment. This example is different from the example illustrated in FIG. 1, in that the source voltage fluctuation detector circuit 141 is constituted by a comparator with an offset 401 and the circuit controlled by the second output signal of the ON/OFF circuit 107 is set as the PMOS transistor 109*b* directly controlling the node N2. The other circuits are the same as illustrated in FIG. 1 and thus detailed description thereof will not be repeated.

In the voltage regulator according to this embodiment having the configuration illustrated in FIG. 2, the same advantageous effect as in the voltage regulator illustrated in FIG. 1 can be achieved. It is also possible to suppress the occurrence of overshooting in the output voltage VOUT at the starting time at which the circuitry is turned on from the state in which the circuitry is turned off by the ON/OFF circuit 107 by supplying the source voltage VDD thereto.

As described above, since the voltage regulator according to the invention can prevent overshooting in the output voltage, it is possible to prevent erroneous operation or malfunction of a portable apparatus or an electronic apparatus working using the voltage regulator as a power source.

What is claimed is:

1. A voltage regulator comprising:

an error amplifier circuit that amplifies and outputs a difference between a divided voltage of an output voltage from an output transistor and a reference voltage and that controls the gate of the output transistor;

an overshooting control circuit connected to the gate of the output transistor and to a source voltage terminal and to a first node and to a second node;

an ON/OFF circuit that controls ON and OFF states of at least the error amplifier circuit, wherein, upon supplying power to the source voltage terminal, the ON/OFF circuit controls the overshooting control circuit so as to turn on the output transistor when a predetermined time passes after at least the error amplifier circuit is turned on, and wherein the first and second nodes have opposite voltage states; and a source voltage fluctuation detector circuit that detects a fluctuation in a source voltage, wherein the overshooting control circuit is controlled by a signal output from the source voltage fluctuation detector circuit to the first node and a signal output from the ON/OFF circuit, and the source voltage fluctuation detector circuit includes a comparator in which the reference voltage is input to a non-inverting input terminal thereof, the divided voltage is input to an inverting input terminal thereof, an output thereof is connected to the overshooting control circuit, and the non-inverting input terminal has an offset voltage.

2. The voltage regulator according to claim 1, wherein the ON/OFF circuit includes:

a first control terminal that outputs a first control signal that controls the ON and OFF states of at least the error amplifier circuit, and a second control terminal that outputs a second control signal that controls the ON and OFF states of the overshooting control circuit.

3. The voltage regulator according to claim 2, wherein the ON/OFF circuit is configured to slowly increase the second control signal.

4. A voltage regulator comprising:

an error amplifier circuit that amplifies and outputs a difference between a divided voltage of an output voltage output from an output transistor and a reference voltage and that controls the gate of the output transistor;

an overshooting control circuit that is connected to the gate of the output transistor and controlled by a signal output from a source voltage fluctuation detector circuit;

wherein the source voltage fluctuation detecting circuit includes:

a capacitor and a first impedance element connected in series between a power source terminal and a ground terminal, and a second impedance element and a transistor connected in series between the power source terminal and the ground terminal, wherein the gate of the transistor is connected to a connecting point of the capacitor and the first impedance element, and the connecting point of the second impedance element and the transistor is an output terminal of the source voltage fluctuation detector circuit; and an ON/OFF circuit that controls ON and OFF states of at least the error amplifier circuit, wherein the ON/OFF circuit controls the overshooting control circuit so as to turn on the output transistor when a predetermined time passes after at least the error amplifier circuit is turned on starting the voltage regulator.

5. An electronic apparatus comprising the voltage regulator according to claim 1.

* * * * *